US006276926B1

(12) United States Patent
Chen et al.

(10) Patent No.: US 6,276,926 B1
(45) Date of Patent: Aug. 21, 2001

(54) INJECTOR FOR WATER FREE OF EXTERNAL TORCH

(75) Inventors: Tony Chen, Chia-Yi Hsien; I-Ho Huang, Hsinchu, both of (TW)

(73) Assignee: United Microelectronics Corp., Hsinchu (TW)

( * ) Notice: Subject to any disclaimer, the term of this patent is extended or adjusted under 35 U.S.C. 154(b) by 0 days.

(21) Appl. No.: 09/686,248

(22) Filed: Oct. 11, 2000

(30) Foreign Application Priority Data

Sep. 20, 2000 (TW) ..... 89119320

(51) Int. Cl.[7] ..... F23D 14/46
(52) U.S. Cl. ..... 431/350; 431/119; 431/354
(58) Field of Search ..... 431/2, 117, 118, 431/119, 350, 354

(56) References Cited

U.S. PATENT DOCUMENTS 3,364,967 * 1/1968 Solak ..... 431/117
4,664,619 * 5/1987 Johnson et al. ..... 431/119
4,773,848 * 9/1988 Jalbert ..... 431/119
5,085,576 * 2/1992 Boone et al. ..... 431/119

* cited by examiner

*Primary Examiner*—James C. Yeung
(74) *Attorney, Agent, or Firm*—Thomas, Kayden, Horstmeyer & Risley, LLP

(57) ABSTRACT

An injector for water free of external torch external torch gas injector comprising an outer tube, a first inner tube and a second inner tube. The outer tube has a side tube and a plurality of outer tube emission holes. The outer wall of the outer tube joins with a ball-and-socket joint. The plurality of outer tube emission holes is at the front end of the outer tube. The outer tube encloses the first inner tube. The first inner tube has a side tube and an inner tube emission hole. The inner tube emission hole is also at the front end of the outer tube. The outer tube also encloses the second inner tube. The second inner tube has an inner tube inlet and an inner tube emission hole. The second inner tube inlet is at the back end of the outer tube. The second inner tube emission hole is on the wall of the outer tube, near the largest cross-section of the ball-and-socket joint. In an alternative design, a second outer tube emission hole is formed on the wall of the outer tube, near the largest cross-section of the ball-and-socket joint, in place of the second inner tube.

17 Claims, 3 Drawing Sheets

INJECTOR FOR WATER FREE OF EXTERNAL TORCH

CROSS-REFERENCE TO RELATED APPLICATION

This application claims the priority benefit of Taiwan application serial no. 89119320, filed Sep. 20, 2000.

BACKGROUND OF THE INVENTION

1. Field of Invention

The present invention relates to the gas injector of a thermal oxidation station. More particularly, the present invention relates to an injector for water free of external torch.

2. Description of Related Art

Thermal oxidation can be roughly divided into dry oxidation and wet oxidation. In dry oxidation, oxygen together with suitable amount of inert gases or nitrogen gas is passed into a heated furnace (at a temperature of around 900° C.) to initiate the formation of an oxide layer on a silicon wafer. In wet oxidation, rather than passing water vapor directly into a reaction chamber, water formed by reacting gaseous hydrogen with oxygen (at an elevated temperature above 600° C.) is passed into reaction chamber to carry out the oxidation. Since the water vapor formed by reacting hydrogen and oxygen is much purer and cleaner than distilled water, the silicon dioxide ($SiO_2$) layer formed by wet oxidation has good electrical properties.

In general, the reaction between hydrogen and oxygen is carried out at high temperature inside a gas injector. A gas injector can further be distinguished by internal torch or external torch. At present, most oxidation furnace has external torch gas injector. The external torch injector comprises of a hydrogen-oxygen torch chamber and a gas injector. When gaseous hydrogen and gaseous oxygen reacts inside the torch chamber to form water moisture, the moisture is channeled into a quartz oxidation tube via a connection pipe.

FIG. 1 is a sketch showing a conventional external torch gas injector. As shown in FIG. 1, a conventional external torch gas injector 100 includes an outer tube 102 and an inner tube 104. The inner tube 104 is enclosed within the outer tube 102. The outer tube 102 has a side tube 102*a* and separate inner tube emission holes 102*c*, 102*d* and 102*e*. The outer wall of the outer tube 102 is joined to a ball-and-socket joint 108. There is an opening at the back end of the outer tube 102 for inserting a thermocouple 110. The inner tube 104 has a side tube 104*a* and an inner tube emission hole 104*c*. The side tube 102*a* further has an outer tube inlet 102*b* end the side tube 104*a* has an inner tube inlet 104*b*. The side tube 102*a* is roughly perpendicular to the outer tube 102 while the side tube 104*a* is roughly perpendicular to the inner tube 104.

To carry out wet oxidation, a quartz external torch gas injector 100 is used. Gaseous hydrogen ($H_2$) is delivered to the inner tube inlet 104*b* while oxygen ($O_2$) is passed through the outer tube inlet 102*b* into the hydrogen-oxygen torch chamber 112. Oxygen passes from the outer tube inlet 102*b* via three different outer tube emission holes 102*c*, 102*d* and 102*e* into the hydrogen-oxygen torch chamber 112. Hydrogen enters from the inner tube opening 104*b* and passes through the inner tube emission hole 104*c* before delivering into the hydrogen-oxygen torch chamber. Alternatively, the hydrogen can also pass through the inner tube inlet 104*b* into the hydrogen-oxygen torch chamber 112. During wet oxidation reaction, flow rate of oxygen into the hydrogen-oxygen torch chamber 112 must be greater than one half times that of hydrogen. In other word, the mole ratio between hydrogen and oxygen is about 1:1/2 or more to prevent hydrogen accumulation inside the chamber 112. When the concentration of hydrogen and oxygen reaches a suitable level and the temperature rises to a set level, hydrogen and oxygen will automatically ignite according to the reaction formula (a) below:

$$H_{2(g)} + \frac{1}{2}O_{2(g)} \underset{\Delta}{\rightarrow} H_2O_{(g)} \qquad \text{(a)}$$

Water vapor created according to formula (a) will pass out through a connection pipeline into the oxidation chamber for wet oxidation.

After the torching reaction between hydrogen and oxygen has been continued for some time, large number of water droplets 114 may accumulate near the ball-and-socket joint 108 because the temperature there is only about 60° C. These accumulated water droplets 114 may affect subsequent dry oxidation operation leading to non-uniform oxide thickness.

SUMMARY OF THE INVENTION

Accordingly, one object of the present invention is to provide an injector for water free of external torch capable of preventing water vapor produced by hydrogen-oxygen burning from condensing in the cooler part of the injector.

To achieve these and other advantages and in accordance with the purpose of the invention, as embodied and broadly described herein, the invention provides an injector for water free of external torch. The injector includes an outer tube, a first inner tube and a second inner tube. The outer tube has a side tube and a plurality of outer tube emission holes. The outer wall of the outer tube joins with a ball-and-socket joint. The outer tube emission holes are at the front end of the outer tube. The side tube of the outer tube further includes an outer tube inlet. The outer tube inlet is used for channeling in a first gas. The plurality of outer tube emission holes is used for exhausting the first gas. The first inner tube is enclosed inside the outer tube. The first inner tube has a side tube and a first inner tube emission hole. The first inner tube emission hole is also at the front end of the outer tube. The side tube of the first inner tube further includes a first inner tube inlet. The first inner tube inlet is used for channeling in a second gas while the first inner tube emission hole is used for exhausting the second gas. The second inner tube is also enclosed inside the outer tube. The second inner tube has a second inner tube inlet and a second inner tube emission hole. The second inner tube inlet is at the back end of the outer tube. The second inner tube emission hole is on the tube wall of the outer tube, close to the largest cross-section in the ball-and-socket joint. The second inner tube inlet is used for channeling in a third gas. The second inner tube emission hole is used for exhausting the third gas. In an alternative design, besides using a second outer tube emission hole to replace the second inner tube, everything is similar. The distance from the largest cross-section of the ball-and-socket joint to the junction of the ball-and-socket joint is d. The second outer tube emission holes are positioned on the outer wall of the outer tube at a distance –d from the largest cross-section of the ball-and-socket joint. Furthermore, the direction of a sprout on the second outer tube emission holes is tilted at a specified angle relative to the ball-and-socket junction.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention. In the drawings.

DESCRIPTION OF THE PREFERRED EMBODIMENTS

Figure 1:
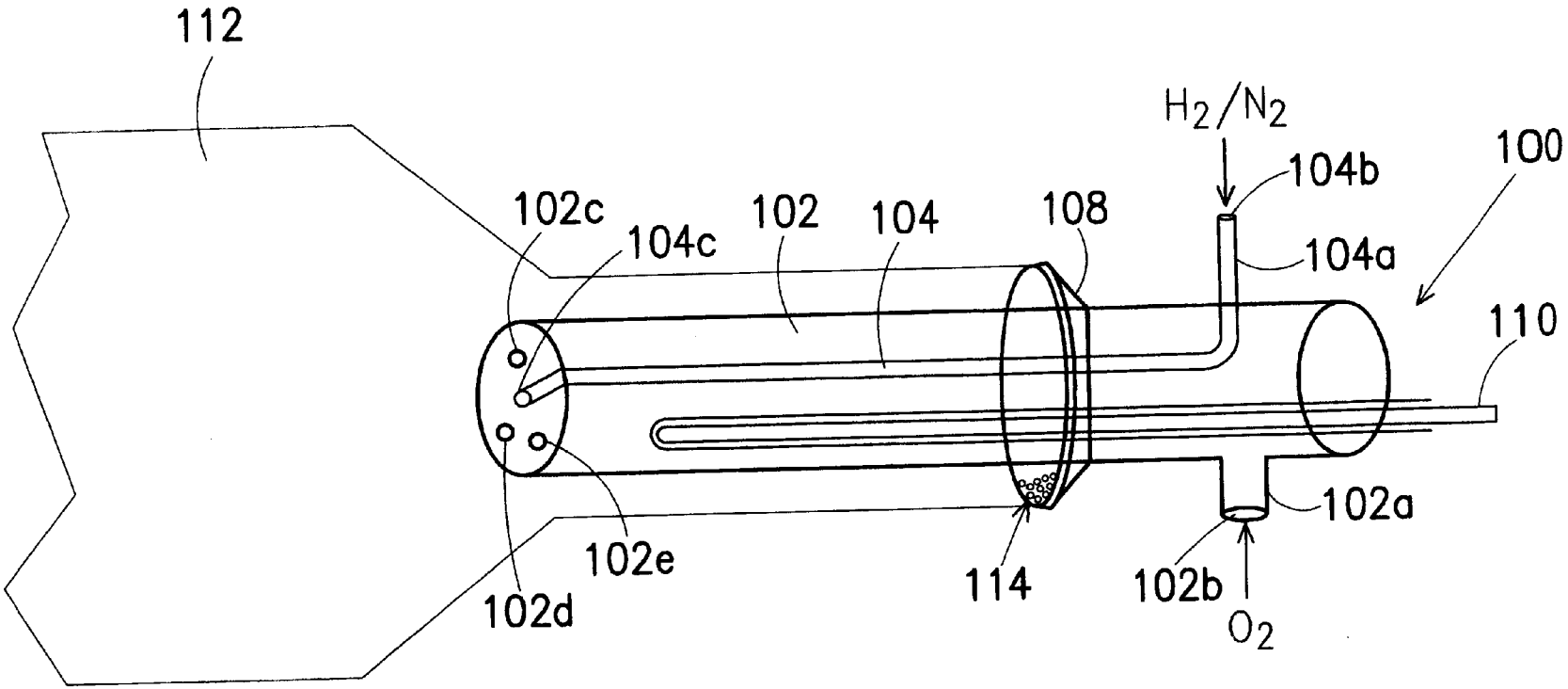
FIG. 1 (PRIOR ART)
FIG. 1 is a sketch showing a conventional external torch gas injector.

Reference will now be made in detail to the present preferred embodiments of the invention, examples of which are illustrated in the accompanying drawings. Wherever possible, the same reference numbers are used in the drawings and the description to refer to the same or like parts.

Figure 2:
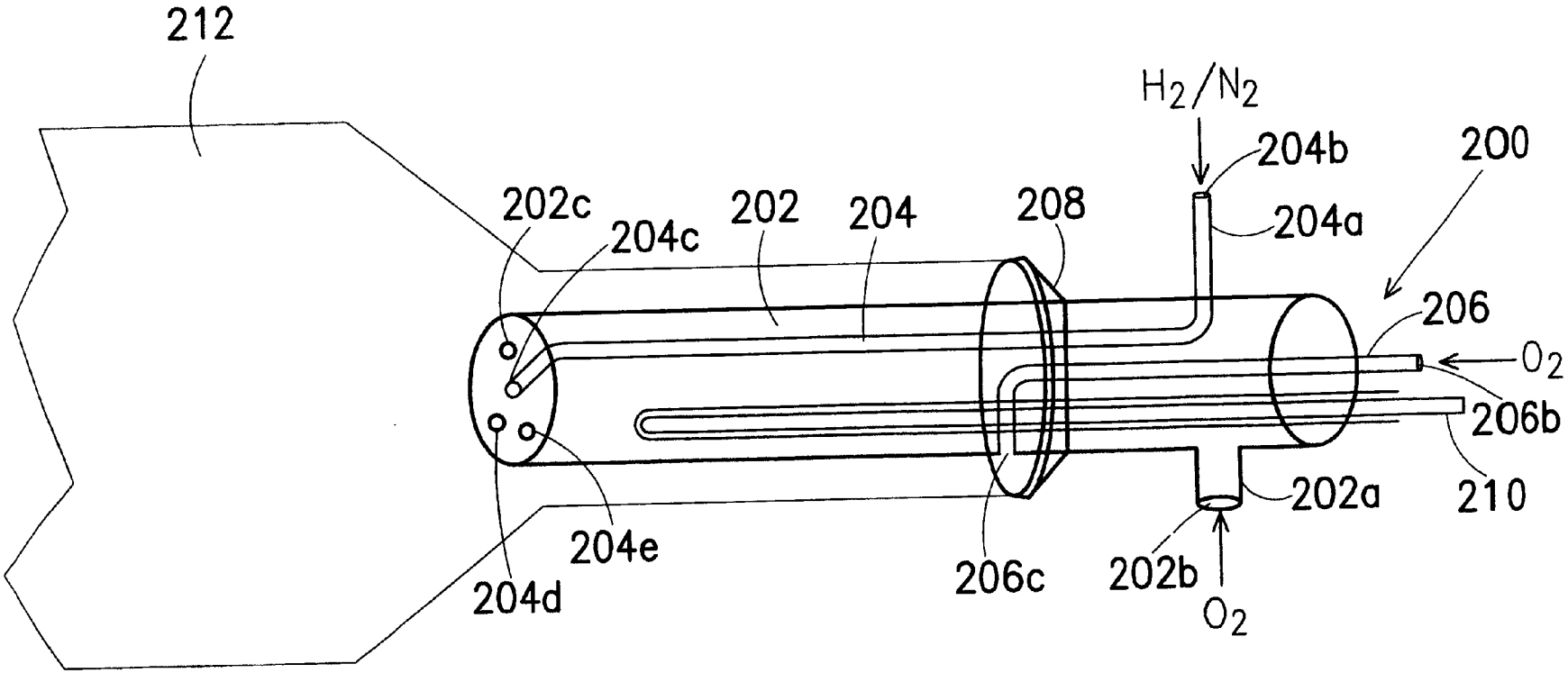
FIG. 2 is a sketch showing an external torch gas injector according to a first preferred embodiment of this invention.

FIG. 2 is a sketch showing an external torch gas injector according to a first preferred embodiment of this invention. In the first embodiment, the external torch gas injector 200 is made from a quartz material, for example. The external torch gas injector 200 includes an outer tube 202, a first inner tube 204 and a second inner tube 206. The outer tube 202 has a side tube 202*a* and three outer tube emission holes 202*c*, 202*d* and 202*e*. The outer wall of the outer tube 202 joins with a ball-and-socket joint 208. The three outer tube emission holes 202*c*, 202*d* and 202*e* are at the front end of the outer tube 202. The side tube 202*a* is perpendicular to the outer tube 202. The side tube 202*a* further includes an outer tube inlet 202*b*. The outer tube inlet 202*b* is responsible for channeling in a first gas and the three outer tube emission holes 202*c*, 202*d* and 202*e* are responsible for exhausting the first gas. The first gas can be oxygen, for example. An opening for inserting a thermocouple 210 is at the back end of the outer tube 202. The first inner tube 204 is inside the outer tube 202. The first inner tube 204 has a side tube 204*a* and an inner tube emission hole 204*c*. The inner tube emission hole 204*c* is also at the front end of the outer tube 202. The side tube 204*a* is perpendicular to the first inner tube 204. The side tube 204*a* further includes an inner tube inlet 204*b*. The inner tube inlet 204*b* is responsible for channeling a second gas into the first inner tube 204 and the inner tube emission hole 204*c* is responsible for exhausting the second gas. The second gas can be hydrogen or nitrogen, for example. The second inner tube 206 is also inside the outer tube 202. The second inner tube 206 has an inner tube inlet 206*b* and an inner tube emission hole 206*c*. The inner tube inlet 206*b* is at the back end of the outer tube 202. The inner tube emission hole 206*c* is on the tube wall of the outer tube 202 close to the largest cross-section of the ball-and-socket joint 208. The second inner tube inlet 206*b* is responsible for channeling in a third gas into the second inner tube 206 and the inner tube emission hole 206*c* is responsible for exhausting the third gas. The third gas can be oxygen having a flow rate of between 100 sccm to 1 slcm, for example.

To carry out a wet oxidation, oxygen is passed into a hydrogen-oxygen torch chamber 212 inside the external torch gas injector 200 through the outer tube inlet 202*b* and the three outer tube emission holes 202*c*, 202*d* and 202*e*. Hydrogen is passed into the hydrogen-oxygen torch chamber 212 through the inner tube inlet 204*b* and the inner tube emission hole 204*c*. During the wet oxidation, the flow of oxygen into the hydrogen-oxygen torch chamber 212 must be greater than one half of the flow of hydrogen. A small amount of oxygen flows is passed into the hydrogen-oxygen torch chamber 212 via the second inner tube inlet 206*b* and the second inner tube emission hole 206*c*. The amount of oxygen is between about 100 sccm to 1 slcm. When the concentration of the oxygen and hydrogen within the torch chamber 212 reaches a suitable level and the temperature is high enough, the gases will ignite automatically. Because a small amount of oxygen continuously exhausts from the inner tube emission hole 206*c* towards the inner wall of the outer tube 202 close to the ball-and-socket joint 208, water vapor created by hydrogen-oxygen burning in the neighborhood of the ball-and-socket joint 208 can be carried away by the oxygen from the gas injector 200. Hence, no water droplets will condense out in the cooler region.

Figure 3:
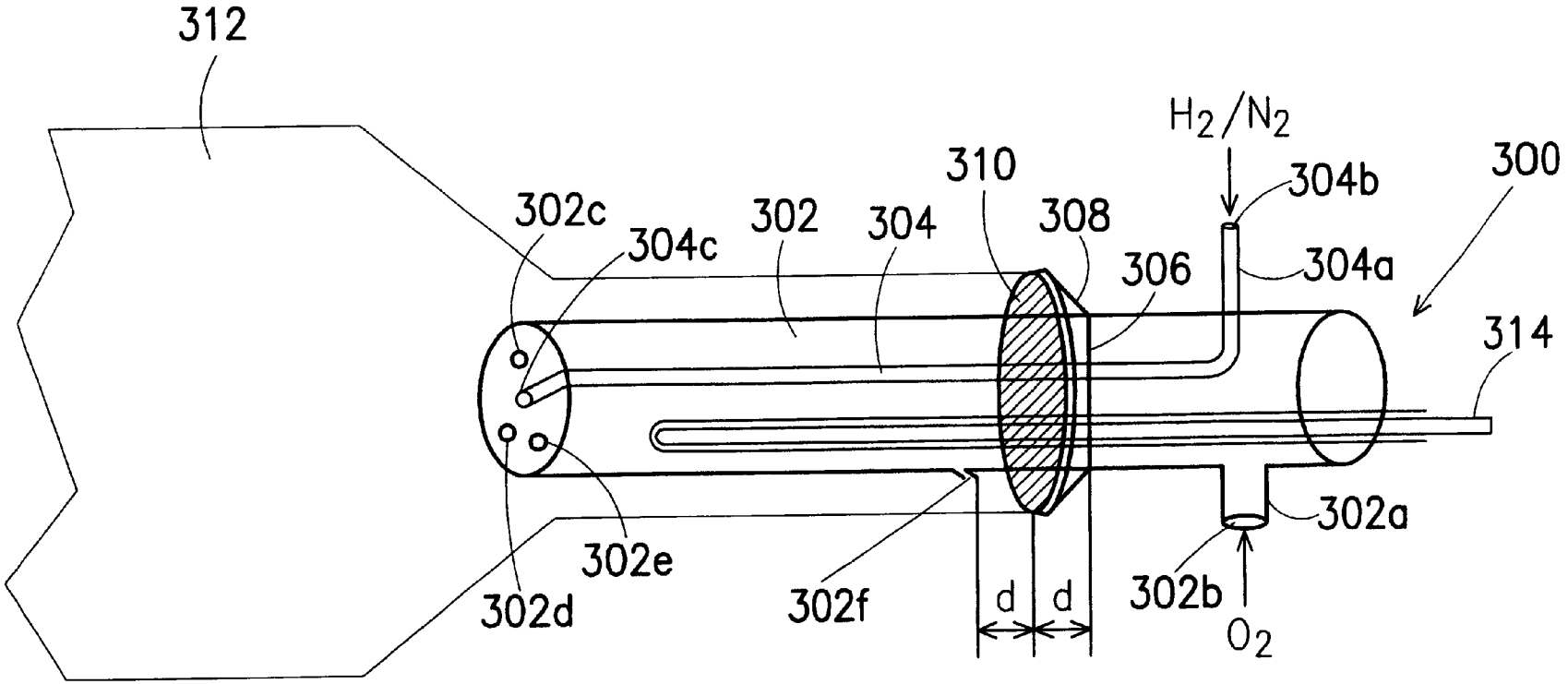
FIG. 3 is a sketch showing an external torch gas injector according to a second preferred embodiment of this invention.

FIG. 3 is a sketch showing an external torch gas injector according to a second preferred embodiment of this invention. The external torch gas injector 300 is made from a material such as quartz. The external torch gas injector 300 includes an outer tube 302 and an inner tube 304. The outer tube 302 has a first side tube 302*a*, three outer tube emission holes 302*c*, 302*d*, 302*e* and an outer tube emission hole 302*f*. A junction 306 on the outer wall of the outer tube 302 joins with a ball-and-socket junction 308. Distance from the largest cross-section of the ball-and-socket junction 308 to the junction 306 is d. The outer tube emission hole 302*f* is on the outer wall of the outer tube at a distance −d from the largest cross-section of the ball-and-socket junction 308. The second outer tube emission hole 302*f* tilts at a specified angle relative to the ball-and-socket joint 308. The specified angle is between 45° to 60°. The three outer tube emission holes 302*c*, 302*d* and 302*e* are at the front end of the outer tube 302. The first side tube 302*a* is perpendicular to the outer tube 302. The first side tube 302*a* further includes an outer tube inlet 302*b*. The outer tube inlet 302*b* is responsible for channeling in a first gas into the outer tube 302. The outer tube emission holes 302*c*, 302*d*, 302*e* and the outer tube emission hole 302*f* are all responsible for exhausting the first gas. The first gas can be oxygen, for example. A hole for inserting a thermocouple 314 is at the back end of the outer tube 302. The inner tube 304 has a second side tube 304*a* and an inner tube emission hole 304*c*. The inner tube emission hole 304*c* is also at the front end of the outer tube 302. The second side tube 304*a* is perpendicular to the inner tube 304. The second side tube 304*a* further includes an inner tube inlet 304*b*. The inner tube inlet 304*b* is responsible for channeling a second gas into the inner tube 304. The inner tube emission hole 304*c* is responsible for exhausting the second gas. The second gas can be hydrogen or nitrogen, for example.

To carry out a wet oxidation, oxygen is passed into a hydrogen-oxygen torch chamber 312 inside the external torch gas injector 300 through the out tube inlet 302*b* and the four outer tube emission holes 302*c*, 302*d*, 302*e* and 302*f*. Hydrogen is passed into the hydrogen-oxygen torch chamber 312 through the inner tube inlet 304*b* and the inner tube emission hole 304*c*. During the wet oxidation, the flow of oxygen into the hydrogen-oxygen torch chamber 312 must be greater than one half of the flow of hydrogen. When the concentration of the oxygen and hydrogen within the torch chamber 312 reaches a suitable level and the temperature is high enough, the gases will ignite automatically. Because a small amount of oxygen continuously exhausts from the outer tube emission hole 302*f* towards the inner wall of the outer tube 302 close to the ball-and-socket joint 308, water vapor created by hydrogen-oxygen burning in the neighborhood of the ball-and-socket joint 308 can be carried away by the oxygen from the gas injector 300. Hence, no water droplets will condense out in the cooler region.

During wet oxidation, hydrogen and oxygen are continuously burned inside the torching chamber. Hence, large number of water droplets may accumulate near the ball-and-socket joint because the temperature there is lower. In this invention, a jet of oxygen aiming at the ball-and-socket joint is set up so that moisture diffused into the neighborhood of the ball-and-socket joint is carried away from the gas injector. Thus, the accumulation of water droplets in the cooler region leading to non-uniform oxide thickness in subsequent dry oxidation can be prevented.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. An injector for water free of external torch, comprising:

an outer tube having a first side tube and a plurality of outer tube emission holes, wherein an outer wall of the outer tube joins with a ball-and-socket joint, the outer tube emission holes is at a front end of the outer tube, the first side tube has an outer tube inlet for channeling in a first gas, and the outer tube emission holes are configured to exhaust the first gas;

a first inner tube within the outer tube, wherein the first inner tube has a second side tube and a first inner tube emission hole, the first inner tube emission hole is at the front end of the outer tube, the second side tube has a first inner tube inlet for channeling in a second gas, and the first inner tube emission hole is configured to exhaust the second gas; and a second inner tube within the outer tube, wherein the second inner tube has a second inner tube inlet and a second inner tube emission hole, the second inner tube inlet is at a back end of the outer tube, the second inner tube emission hole is on a tube wall of the outer tube close to a largest cross-section of the ball-and-socket joint, the second inner tube inlet is configured to channel in a third gas, and the second inner tube emission hole is configured to exhaust the third gas.

2. The injector of claim 1, wherein material forming the external torch gas injector includes quartz.

3. The injector of claim 1, wherein the first side tube and the outer tube are roughly perpendicular to each other.

4. The injector of claim 1, wherein the first gas includes oxygen.

5. The injector of claim 1, wherein the second side tube and the first inner tube are roughly perpendicular to each other.

6. The injector of claim 1, wherein the second gas includes hydrogen.

7. The injector of claim 1, wherein the second gas includes nitrogen.

8. The injector of claim 1, wherein the third gas includes oxygen.

9. The injector of claim 1, wherein the third gas includes oxygen having a flow rate between about 100 sccm to 1 slcm.

10. An injector for water free of external torch, comprising:

an outer tube having a first side tube, a plurality of first type outer tube emission holes and a second type outer tube emission holes, wherein an outer wall of the outer tube joins with a ball-and-socket joint, a largest cross-section of the ball-and-socket joint is at a distance d from the joint, the second type outer tube emission hole is positioned on the outer wall of the outer tube at a distance–d from the largest cross-section of the ball-and-socket joint, the second type outer tube emission hole has a sprout that tilts at a specified angle relative to the ball-and-socket joint, the first type outer tube emission holes is at a front end of the outer tube, the first side tube further includes an outer tube inlet, the outer tube inlet is configured to channel in a first gas, the first type outer tube emission holes and the second type outer tube emission hole are configured to exhaust the first gas; and an inner tube within the outer tube, wherein the inner tube has a second side tube and an inner tube emission hole, the inner tube emission hole is at the front end of the outer tube, the second side tube further includes an inner tube inlet, the inner tube inlet is configured to channel in a second gas, and the inner tube emission hole is configured to exhaust the second gas.

11. The gas injector of claim 10, wherein material forming the external torch gas injector includes quartz.

12. The gas injector of claim 10, wherein the first side tube is roughly perpendicular to the outer tube.

13. The gas injector of claim 10, wherein the first gas include oxygen.

14. The gas injector of claim 10, wherein the specified angle of the sprout is between about 45° to 60° relative to the ball-and-socket joint.

15. The gas injector of claim 10, wherein the second side tube is roughly perpendicular to the first inner tube.

16. The gas injector of claim 10, wherein the second gas includes hydrogen.

17. The gas injector of claim 10, wherein the second gas includes nitrogen.

* * * * *